United States Patent [19]

Wood

[11] 4,330,079

[45] May 18, 1982

[54] INTERLOCKING STRUCTURE FOR A PAIR OF OVERLAPPING PANELS

[75] Inventor: Prentice J. Wood, Hapeville, Ga.

[73] Assignee: The Mead Corporation, Dayton, Ohio

[21] Appl. No.: 202,708

[22] Filed: Oct. 31, 1980

[51] Int. Cl.[3] ..... B65D 5/04

[52] U.S. Cl. ..... 229/40; 229/48 R; 24/204

[58] Field of Search ..... 229/48 R, 40, 35, 36, 229/52 BC, 39 R, 45 R; 206/140, 434, 194, 197; 24/204, 295, 217 R

[56] References Cited

U.S. PATENT DOCUMENTS

| | | | |
|---|---|---|---|
| 3,163,321 | 12/1964 | Weiss | 206/140 |
| 3,963,170 | 6/1976 | Wood | 229/40 |
| 4,093,116 | 6/1978 | Watkins et al. | 229/48 R |

*Primary Examiner*—William Price

*Assistant Examiner*—Gary E. Elkins

*Attorney, Agent, or Firm*—Rodgers & Rodgers

[57] ABSTRACT

For use primarily in article carriers, interlocking structure for securing a pair of face contacting overlapping panels in interlocked relation includes a locking aperture formed in one of the panels and having an anchoring edge and a spaced securing edge disposed in generally parallel relation and including side edges together with a locking tab having a body portion, a heel portion, and a toe portion and being struck from the other of said panels and folded through an angle of approximately 180° toward an adjacent edge thereof and into face contacting relation with the part of the other panel which is disposed adjacent the edge thereof and so as to cause the heel portion to enter the locking aperture and to engage the anchoring edge and to cause the toe portion to enter the locking aperture adjacent the securing edge.

13 Claims, 7 Drawing Figures

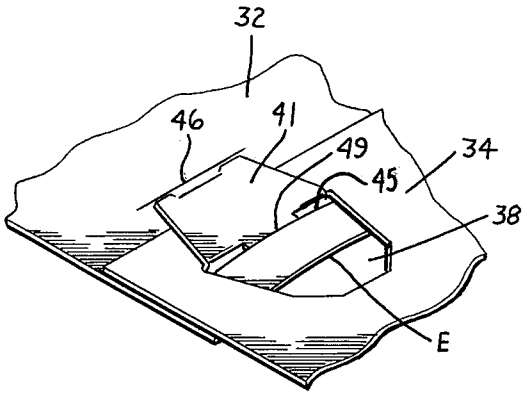
Fig. 2
Fig. 1
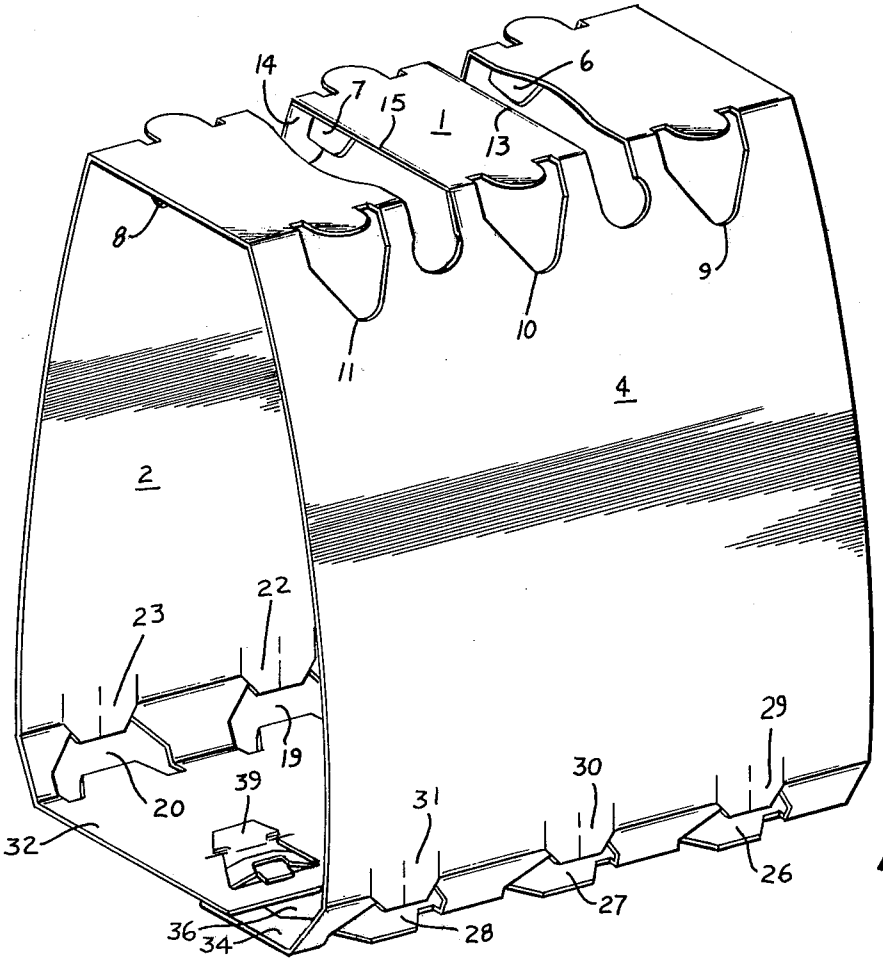

INTERLOCKING STRUCTURE FOR A PAIR OF OVERLAPPING PANELS

TECHNICAL FIELD

This invention relates primarily to the packaging of articles and concerns an interlocking means for securing in interlocked relation a pair of face contacting panels which constitute parts of an article container.

BACKGROUND ART

U.S. Pat. No. 3,248,004 issued Apr. 26, 1966 discloses a bottle carrier of the wraparound type in which locking tabs having heel and toe portions are foldably joined to an end edge of the wrapper blank and in which a plurality of cooperating apertures are formed in the blank adjacent the opposite end thereof. This type of lock is manipulated so as to insert the heel of the lock into the associated locking aperture and thereafter the toe portion of the lock is folded toward the lock and into interlocked relation therewith. This type of lock is satisfactory for some purposes but is objectionable in that the locks project from an end edge of the wrapper and hence constitute an element of cost and are also subject to inadvertent unlocking because the security of the lock depends primarily on the stiffness or fight in the locking toe whereby the toe portion is held in interlocked relation with its associated aperture.

U.S. Pat. No. 3,351,263 issued Nov. 7, 1967 discloses a panel interlocking means wherein a locking tab is struck from one panel and folded through one aperture in another panel to be interlocked and thence inserted subsequently through a second aperture formed in the other panel. While this type of locking arrangement provides an effective lock, manipulative operations necessary to form the lock are somewhat difficult to perform at high speed in high speed packaging machines.

British Pat. No. 1,436,166 published May 19, 1976 discloses a wrapper type package in which apertures are formed at one end of the blank and locking tabs project outwardly from the opposite end of the blank and slots formed near the base of the locking tabs receive shoulder portions of the locking tabs after they are inserted through the locking apertures during a package forming operation. This type of lock requires manipulative operations of substantial complexity.

DISCLOSURE OF THE INVENTION

According to this invention in one form, a secure lock is provided for use primarily in article containers and is for the purpose of interlocking a pair of panels in flat face contacting relation with each other. According to this invention, a locking aperture is formed in one of the panels to be interlocked and includes spaced apart side edges and generally parallel spaced apart anchoring and securing edges. Struck from the other panel to be interlocked and foldably joined thereto is a locking tab having a body portion, a heel portion, and a toe portion foldably joined to the body portion. During formation of the lock, the locking tab is folded out of the plane of its associated panel through an angle of approximately 180° C. while the heel portion is inserted into the locking aperture and into engagement with the anchoring edge. The body portion is folded toward the plane of the other panel and the toe portion is inserted through the locking aperture adjacent the securing edge thereof so that when the lock is formed the body portion of the locking tab is disposed in enveloping face contacting relation with the edge portion of the panel from which the locking tab is struck.

BRIEF DESCRIPTION OF THE DRAWINGS

In the drawings

FIG. 1 is an isometric view of a completed wrapper type package formed according to the invention but which does not include the packaged articles;

FIG. 2 is a perspective view of one of the interlocking means including the locking tab and its associated locking aperture as the lock appears from below;

BEST MODE OF CARRYING OUT THE INVENTION

Figure 3:
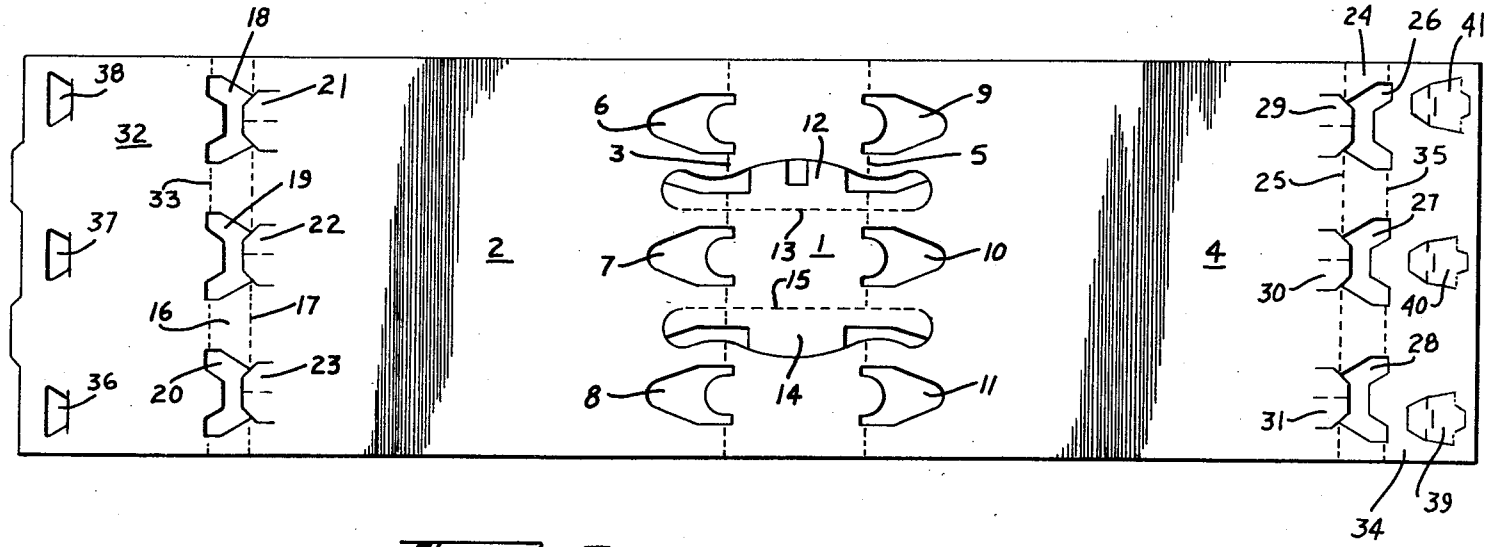
FIG. 3 is a plan view of a wrapper used to form the carrier shown in FIG. 1.

In the drawings the numeral 1 generally designates the top panel of the carrier. Side wall 2 is foldably joined to top panel 1 along interrupted fold line 3 while side wall 4 is foldably joined to top panel 1 along interrupted fold line 5. Corner apertures 6–8 are formed in the upper portion of side wall 2 and similar corner apertures 9–11 are formed in the upper portion of side wall 4. A handle reinforcing flap 12 is foldably joined to top panel 1 along fold line 13 and a similar handle reinforcing flap 14 is foldably joined to top panel 1 along fold line 15. When the carrier is completed, the reinforcing panels 12 and 14 are folded downwardly and underneath those portions of top panel 1 which are immediately adjacent and between the fold lines 13 and 15 respectively.

A sloping panel 16 is foldably joined to the bottom edge of side wall 2 along interrupted fold line 17 and apertures 18, 19 and 20 are formed in the sloping panel 16 and receive the bottom portions of packaged articles such as bottles. Associated with the apertures 18–20 are yieldable tabs 21, 22, and 23 which are well known in the art and which cooperate with the associated apertures to receive the lower portions of the articles.

In similar fashion sloping panel 24 is foldably joined to the bottom edge of side wall 4 along interrupted fold line 25 and apertures 26, 27, and 28 are formed in sloping panel 24 and correspond with the apertures 18, 19 and 20. In like fashion tabs 29, 30 and 31 are associated with the apertures 26–28 inclusive and cooperate with these apertures to receive the lower portions of the packaged articles as is well known.

Foldably joined to the sloping panel 16 is a bottom lap panel 32. This panel is foldably joined to sloping panel 16 along interrupted fold line 33 while bottom lap panel 34 is foldably joined to sloping panel 24 along interrupted fold line 35.

Formed in lap panel 32 in accordance with this invention are a plurality of locking apertures 36, 37, and 38 while locking tabs 39, 40, and 41 are struck from lap panel 34. The locking apertures 36–38 and locking tabs 39–41 are identical and locking aperture 38 and locking tab 41 are here described primarily with reference to FIGS. 4–7.

Figure 4:
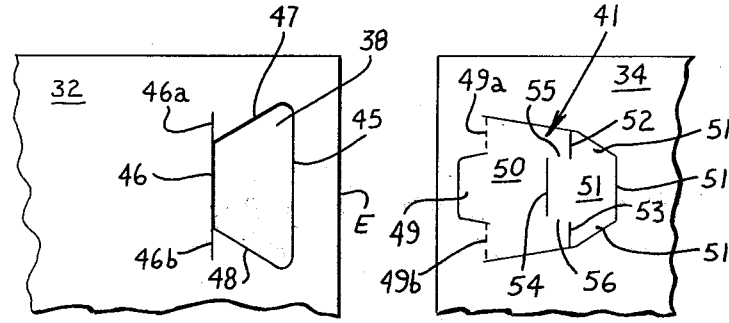
FIG. 4 is a view of a locking aperture and of a locking tab formed according to this invention as seen from below.

FIG. 2 is a perspective view from below of the lock comprising locking aperture 38 and locking tab 41. FIGS. 4–7 are plan views of the same structure as seen from below. As is best shown in FIG. 4, locking aperture 38 is defined by an anchoring edge 45, a securing edge 46 and a pair of angularly disposed side edges 47 and 48. Securing edge 46 includes end portions 46*a* and 46*b* which extend outwardly beyond the adjacent end edges of the adjacent ends of side edges 47 and 48 respectively.

Locking tab 41 includes a heel portion 49, a body portion 50 which is integral with the heel portion 49 together with a toe portion 51. Body portion 50 is foldably joined to panel 34 by means of aligned fold lines 49*a* and 49*b*. Toe portion 51 is defined by slits 52, 53, and 54 which facilitate manipulation of the toe portion 51 relative to the body portion 50. The unslit or uncut fastening part 55 between the adjacent ends of slits 52 and 54 together with the uncut fastening part 56 between adjacent ends of slits 53 and 54 serve to foldably retain the toe portion 51 as an integral part of body portion 50 of the locking tab 41.

Figure 5:
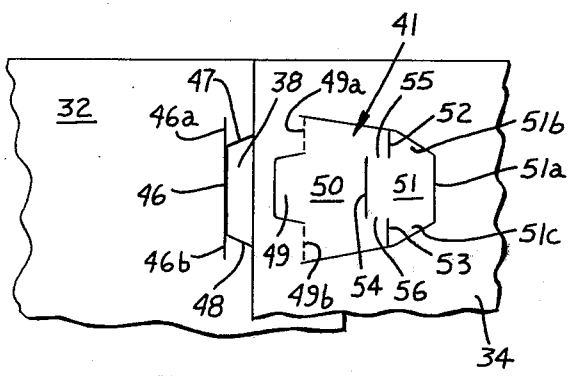
FIG. 5 is a view similar to FIG. 4 and which shows the panels to be interlocked immediately prior to the beginning of a locking operation.

In order to initiate a lock forming operation, the panels 32 and 34 are oriented into the positions represented in FIG. 5. In this orientation, the fold lines 49*a* and 49*b* on opposite sides of the heel 49 are in approximate coincidence with the anchoring edge 45 of the locking aperture 38. Since the view in FIGS. 4–7 is from below, panel 34 is shown in overlying relation relative to the panel 32.

Figure 6:
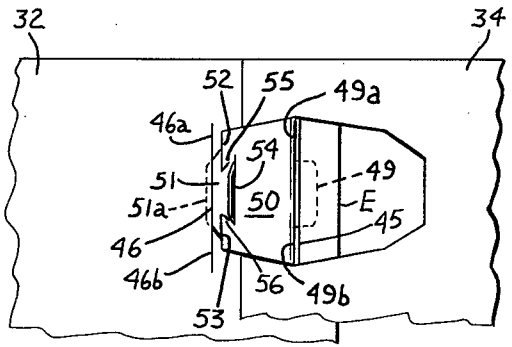
FIG. 6 is a view similar to FIG. 5 but which shows the locking operation during an intermediate stage of the formation of the lock and FIG. 7 shows the lock completely formed and corresponds with FIG. 2.

With the parts oriented as represented in FIG. 5, the body portion 50 of the locking tab 41 having been previously dislodged downwardly sufficiently to be engaged by stationary guides is then elevated together with the toe portion 51 and these structures are folded toward the left about fold lines 49*a* and 49*b* to cause the heel 49 to enter the locking aperture 38 and to swing underneath that portion of panel 32 which is disposed between anchoring edge 45 and edge E of panel 32. This operation causes the heel 49 to occupy the position indicated by dotted lines in FIG. 6 and causes the toe portion 51 to assume an angular relationship to the body portion 50 as shown in FIG. 6 due to swinging movement of the toe portion 51 about the fastening parts 55 and 56. At this stage the part of the toe portion 51 remote from this slit 52, 53 and 54 is partially inserted into the locking aperture 38 and is disposed immediately adjacent the securing edge 46. This outer extremity of toe 51 is designated at 51*a* and is shown by a dotted line in FIG. 6.

Figure 7:
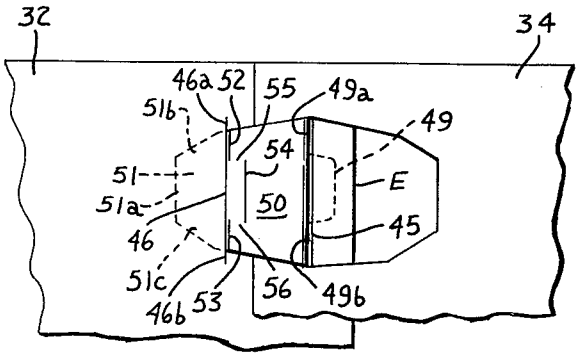

Thereafter the body portion 50 is pressed toward the panels 32 and 34 and causes the toe portion to move toward the left to the position shown in dotted lines in FIG. 7. Of course the body portion 50 is exposed to view from below and the heel portion 49 occupies the position represented by dotted lines in FIG. 7. The heel portion 49, being disposed underneath that portion of panel 32 which is between the anchoring edge 45 and edge E of panel 32, bows such portion somewhat as is apparent from FIG. 2 where the edge E is shown as being of arcuate configuration.

As is best shown in FIG. 4 the toe portion 51 includes transverse shoulder portions 51*b* and 51*c* which extend from a neck portion and which are defined respectively by the slits 52 and 53. The outer extremities of shoulder portions 51*b* and 51*c* are spaced apart by a distance approximating the length of securing edge 46 including its end portions 46*a* and 46*b*. Once the toe portion is fully inserted with its shoulders 51*b* and 51*c* occupying the positions represented in FIG. 7, those parts of securing edge 46 designated by the numerals 46*a* and 46*b* snap back into coplanar relationship and thus prevent inadvertent dislodgment of the toe 51 through the slits 46*a* and 46*b*.

With the locks fully formed as represented in FIGS. 1, 2 and 7, the aligned fold lines 49*a* and 49*b* are in abutting contact with the anchoring edge 45 of the locking aperture 38 due to the fact that the portion of panel 32 between the anchoring edge 45 and the edge E is bowed upwardly as viewed from below by the heel 49 which is in direct contact therewith. While this bowing action is in an upward direction as viewed in FIG. 2, it is obvious that this bowing action is in a downward direction if the structure of FIG. 2 is inverted to occupy its normal position as represented for example in FIG. 1. This abutting engagement of anchoring edge 45 and of aligned fold lines 49*a* and 49*b* effectively precludes any significant relative movement between lap panels 32 and 34 in an outward direction which would in effect allow the transverse dimension of the carrier between the bottom portions of side walls 2 and 4 to be enlarged. Stated otherwise this abutting action as described secures the composite bottom panel comprising lap panels 32 and 34 against relative movement which would tend to increase the width of the bottom panel. Relative movement of lap panels 32 and 34 in the opposite direction which would tend to narrow the width of the composite bottom panel is effectively precluded by the fact that securing edge 46 comes into abutting engagement with the aligned slits 52 and 53. This abutting engagement also secures the locking toe 51 from dislodgement from the locking aperture 38 and thus effectively secures the interlocking of panels 32 and 34 together and precludes inadvertent separation of the lap panels 32 and 34.

While the arrangement shown in the drawings and as described herein includes a single heel tab 49, it is obvious that for some applications of the invention, the heel 49 may comprise a plurality of tabs in side by side relation.

From the description it is apparent that the locks according to this invention may be formed by static plows as the carrier is moved through a packaging machine and that timing of machine elements is not required. Furthermore precise alignment of the locking apertures and tabs is not required and unlike some prior art structures, the locking tab does not project outwardly from an edge of the wrapper of the blank so that inadvertent damage to the lock is unlikely. Furthermore since the elements are formed within the confines of the panels to be interlocked and are not appended structures and because of the disposition of the locking tabs and apertures relative to the panels to be interlocked, a minimum of material is required.

INDUSTRIAL APPLICABILITY

While the locks formed according to this invention have been shown and described in connection with lap panels which constitute a composite bottom panel of a carrier, it is obvious that this interlocking means formed according to this invention is not limited to this particular application and may be used for example to interlock hinged doors formed at the open ends of a wraparound type carton or may have many other applications.

I claim:

1. Interlocking structure for a pair of overlapping panels comprising a locking aperture formed in one of said panels and having an anchoring edge and a securing edge spaced from said anchoring edge and generally parallel thereto, and a locking tab having a body portion, a heel portion, and a toe portion and being struck from the other of said panels near an edge thereof and folded through an angle of approximately 180° and into face contacting relation with the part of said other panel which is disposed adjacent said edge thereof and so as to cause said heel portion to enter said locking aperture and to engage said anchoring edge and to cause said toe portion to enter said locking aperture adjacent said securing edge so that when the lock is formed the body portion of the locking tab is disposed in enveloping face contacting relation with the edge portion of the panel from which the locking tab is struck.

2. Interlocking means according to claim 1 wherein said heel portion of said locking tab is disposed in substantially the same plane as said body portion and normally is disposed approximately midway between the ends of said anchoring edge of said locking aperture.

3. Interlocking means according to claim 1 wherein said toe portion of said locking tab is foldably joined to said body portion thereof.

4. Interlocking means according to claim 3 wherein said toe portion of said locking tab is foldably joined to said body portion thereof by a pair of spaced uncut fastening parts.

5. Interlocking means according to claim 1 wherein said toe portion of said locking tab includes a pair of transverse shoulder portions.

6. Interlocking means according to claim 5 wherein said locking aperture is defined by a pair of spaced apart side edges extending between said anchoring edge and said securing edge and wherein the ends of said securing edge extend into said one panel in a transverse direction a distance beyond the adjacent end edges of said side edges of said locking aperture respectively.

7. Interlocking means according to claim 6 wherein the outer extremities of said shoulder portions of said toe portion of said locking tab are spaced apart by a distance approximating the length of said securing edge of said locking aperture.

8. Interlocking means according to claim 1 wherein said body portion of said locking tab is foldably joined to said other panel by a pair of aligned fold lines disposed on opposite sides of said heel portion of said locking tab.

9. Interlocking means according to claim 1 wherein the portion of said one panel between said anchoring edge of said locking aperture and the adjacent edge of said one panel will be bowed into arcuate configuration due to engagement with said heel portion of said locking tab when disposed in panel interlocking condition.

10. Interlocking means according to claim 8 wherein said pair of aligned fold lines are disposed in abutting generally parallel relation to said anchoring edge of said locking aperture when arranged in panel interlocking positions.

11. A generally rectangular blank for a wrap around type article carrier having a lap panel at each end and comprising at least one locking aperture formed in one of said lap panels and including generally parallel spaced anchoring and securing edges arranged in generally parallel relation to the end edge of said one lap panel, at least one locking tab struck from the other of said lap panels and including a body portion foldably joined thereto by a pair of aligned fold lines and projecting inwardly from the end edge of said other lap panel, a heel portion formed integrally with said body portion and projecting outwardly toward the end edge of said other lap panel, and a toe portion foldably joined to said body portion and projecting inwardly from the end edge of said other lap panel.

12. A blank according to claim 11 wherein said anchoring edge is disposed between said securing edge and the end edge of said one lap panel and wherein spaced side edges extend between said anchoring edge and said securing edge to define a quadrilateral configuration of said locking aperture.

13. A blank according to claim 11 wherein said toe portion of said locking tab includes oppositely disposed shoulders and a central neck portion.

* * * * *